United States Patent [19]

Chister

[11] Patent Number: 4,524,782

[45] **Date of Patent: * Jun. 25, 1985**

[54] TOBACCO SMOKING PIPE HAVING SELF-CONTAINED CLEANING ASSEMBLY

[76] Inventor: René Chister, 20702-177 El Toto Rd., El Toro, Calif. 92630

[ * ] Notice: The portion of the term of this patent subsequent to Oct. 23, 2001 has been disclaimed.

[21] Appl. No.: 464,457

[22] Filed: Feb. 7, 1983

Related U.S. Application Data

[63] Continuation-in-part of Ser. No. 431,470, Sep. 30, 1982, Pat. No. 4,478,228.

[51] Int. Cl.[3] ..... A24F 3/02

[52] U.S. Cl. ..... 131/180; 131/182; 131/184.2; 131/184.3

[58] Field of Search ..... 131/178, 180, 181, 182, 131/184 A, 184 B, 198 R, 271, 228, 193, 330, 329, 185, 193, 228, 201

[56] References Cited

U.S. PATENT DOCUMENTS

| | | | |
|---|---|---|---|
| 60,282 | 12/1966 | Tellgman | 131/184 B |
| 919,515 | 4/1909 | Allen | 131/180 |
| 1,010,951 | 12/1911 | Prunty | 131/181 |
| 1,011,747 | 12/1911 | Clark | 131/180 |
| 1,050,005 | 1/1913 | Crume et al. | 131/180 |
| 1,232,310 | 7/1917 | Hoefler | 131/180 |
| 1,243,803 | 10/1917 | Bradley | 131/180 |
| 1,545,964 | 7/1925 | Laucks | 131/184 B |
| 2,210,791 | 8/1940 | Blum | 131/181 |
| 2,218,414 | 10/1940 | Blum | 131/181 |
| 2,232,092 | 2/1941 | Bellin | 131/184 R |
| 2,419,509 | 4/1947 | Turner | 131/201 |
| 2,543,168 | 2/1951 | Herriott | 131/182 |
| 2,778,363 | 1/1957 | Anderson | 131/181 |
| 4,252,135 | 2/1981 | Herman | 131/180 |

FOREIGN PATENT DOCUMENTS

| | | | |
|---|---|---|---|
| 8760 | of 1892 | United Kingdom | 131/180 |

*Primary Examiner*—V. Millin
*Assistant Examiner*—H. Macey
*Attorney, Agent, or Firm*—Klein, Szekeres & Fischer

[57] ABSTRACT

A unique pipe configuration including a magazine in which a supply of tobacco may be stored, so that a smoker will not be required to waste excess time and effort to continuously replenish the pipe with new tobacco when a plug of tobacco therein has been exhausted. A desired amount of the tobacco supply is moved from the magazine into a hollow cutting and smoking chamber by a manually operated piston. A plug of tobacco is cut from the supply thereof by a hollow tobacco cutter and transport device having a cutting surface formed at one end thereof. The cutter and transport device is adapted to ride through the cutting and smoking chamber so as to cut off and move the tobacco plug through the cutting and smoking chamber to a particular location thereof wherein the tobacco plug is smoked. The pipe location at which the tobacco plug is smoked is separated and spaced apart from the communication of the pipe stem with the cutting and smoking chamber. By positioning the tobacco plug at a location apart from the pipe stem, burning tobacco ash will be retained within the cutting and smoking chamber and not drawn along the pipe stem to the mouth of the smoker. Located within and adapted for reciprocal movement through the hollow interior of the tobacco cutter and transport device is a cleaning assembly which permits a quick and easy periodic cleaning of the pipe.

9 Claims, 10 Drawing Figures

TOBACCO SMOKING PIPE HAVING SELF-CONTAINED CLEANING ASSEMBLY

CROSS REFERENCES TO RELATED PATENT APPLICATIONS

This patent application is a continuation-in-part of application Ser. No. 431,470 filed Sept. 30, 1982, now U.S. Pat. No. 4,478,228.

BACKGROUND OF THE INVENTION

1. Field of the Invention

This invention relates to a pipe having a self-contained cleaning assembly and a unique configuration including a magazine in which a supply of tobacco may be stored. Cutting and transport means are provided by which to cut off a plug from the tobacco supply and move the plug into a chamber where the plug may be smoked without burning ash therefrom being drawn to the mouth of the smoker by way of the pipe stem.

2. Prior Art

Pipes have been used for many centuries as a means by which to permit tobacco to be smoked. In a conventional pipe, a supply of tobacco is placed within the pipe bowl, and smoke is inhaled by the user through an elongated pipe stem that interfaces with the bowl. However, and as will be known to the frequent pipe smoker, the conventional pipe configuration is characterized by several shortcomings.

More particularly, the stem of the conventional pipe is typically arranged to form a direct passageway from the pipe bowl to the mouth of the user. Consequently, and while a plug of tobacco is being smoked, the smoker may undesirably draw burning tobacco ash from the pipe bowl into his mouth via the pipe stem. Such undesirable action may cause the smoker to burn either his mouth or tongue.

Another common disadvantage of the conventional pipe configuration is the limited amount of space that is commonly available within the bowl to receive a plug of tobacco. Thus, because a plug of tobacco is usually smoked in a relatively short amount of time, the user must frequently take time to replenish the pipe bowl with new supplies of tobacco from a tobacco pouch or cannister. The action of repeatedly supplying the pipe bowl with tobacco is both inconvenient and time consuming. Moreover, the pipe smoker must have ready access to a suitable pouch or cannister.

Still another disadvantage that is associated with the conventional pipe relates to the operation of pipe cleaning. It is customary for the pipe smoker to carry on his person pipe cleaners or similar articles in order to affect a cleaning of the pipe. However, the pipe cleaners may be either lost or forgotten, thereby requiring that the smoker find suitable substitutes. Such substitutes are not always available, and the smoker may be left with no adequate means by which to periodically clean his pipe. Used pipe cleaners are characteristically covered with burnt tobacco residue and, therefore, the reuse and transport thereof on the body of the smoker are undesirable. The conventional pipe cleaning operation is further complicated by typically requiring the smoker to strike the pipe bowl against a hard surface to dislodge tobacco residue. Such action is frequently time consuming and dirty.

Examples of prior art pipes may be found by referring to one or more of the following U.S. patents:

| U.S. PAT. NO. | ISSUE DATE |
|---|---|
| 919,515 | April 27, 1909 |
| 1,010,951 | December 5, 1911 |
| 1,011,747 | December 12, 1911 |
| 1,050,005 | January 7, 1913 |
| 1,053,039 | February 11, 1913 |
| 1,213,021 | January 16, 1917 |
| 1,232,310 | July 3, 1917 |

SUMMARY OF THE INVENTION

It is a primary object of the present invention to provide a compact pipe for smoking tobacco, which pipe may be easily disassembled to permit easy cleaning or repair.

It is another object of the present invention to provide a pipe having a magazine in which a supply of tobacco may be stored to replenish an exhausted tobacco plug.

It is yet another object of this invention that the present pipe include a piston for manually forcing a desired amount of the tobacco supply from the magazine into a hollow cutting and smoking chamber and a hollow cutter and transport means for cutting a plug of tobacco from the supply thereof and moving the plug to a location within the cutting and smoking chamber where the plug may be smoked.

It is an additional object of the present invention that the location within the cutting and smoking chamber where the tobacco is smoked is separated and spaced apart from the pipe stem, such that burning tobacco will be trapped within the cutting and smoking chamber and not drawn along the pipe stem to the mouth of the smoker.

It is a further object of this invention that the pipe include a self-contained cleaning means by which to permit the pipe to be easily and quickly cleaned without the necessity of striking the pipe against a hard surface.

It is a still further object of this invention that the self-contained cleaning means be adapted for reciprocal movement through the interior of the cutter and transport means to facilitiate the pipe cleaning operation and eliminate the need for conventional pipe cleaners.

Further objects and advantages of the present invention will become apparent as the following description proceeds and the features of novelty which characterize this invention are pointed out with particularity in the claims annexed hereto.

BRIEF DESCRIPTION OF THE PREFERRED EMBODIMENT

Figure 1:
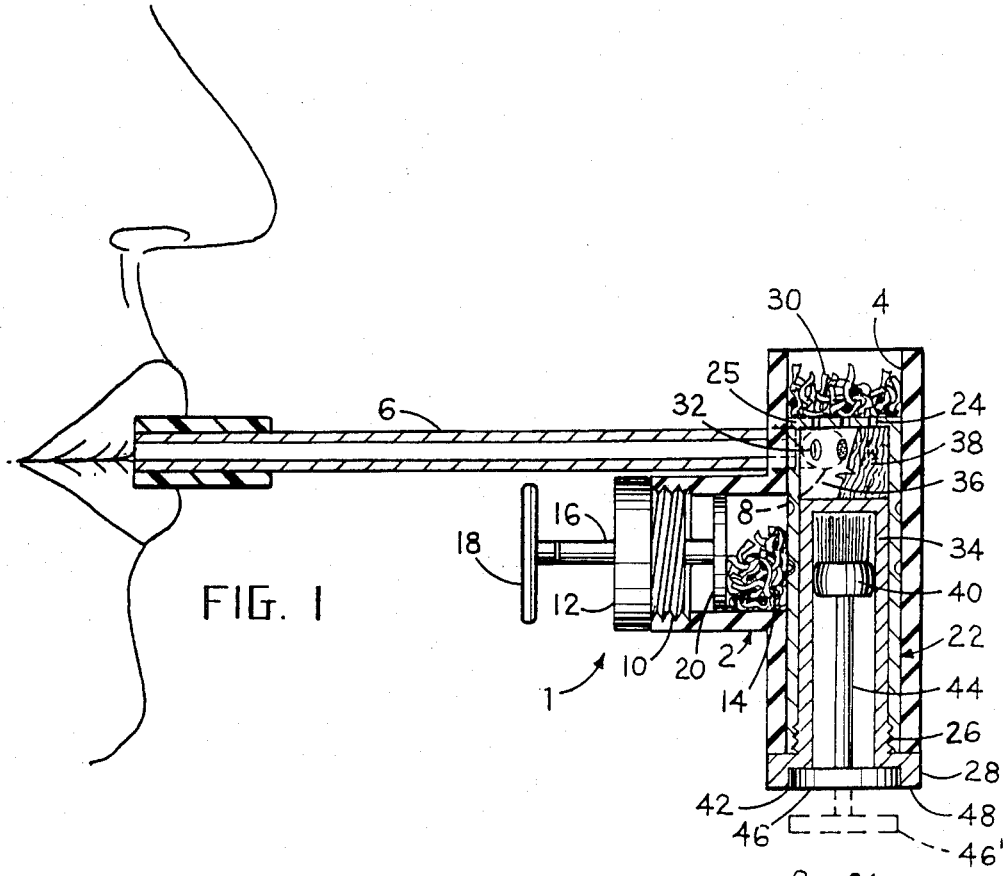
FIG. 1 shows a partial cross-section through the side of the tobacco smoking pipe which forms a first preferred embodiment of the present invention.
Figure 2:
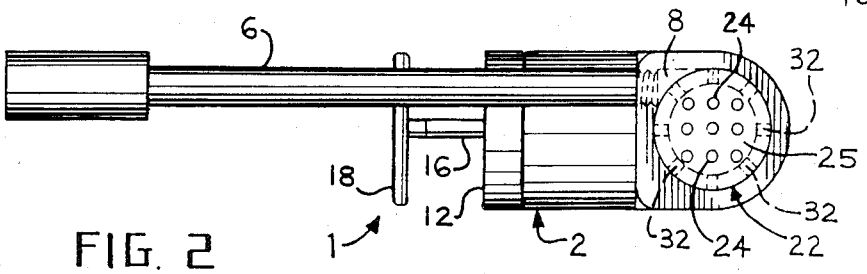
FIG. 2 shows a top view of the pipe of FIG. 1.

The structure of a tobacco smoking pipe according to a first preferred embodiment of the present invention is best described while referring concurrently to FIGS. 1 and 2 of the drawings. The body of pipe 1 is preferably fabricated from a durable material such as brass, or the like. However, the material by which to fabricate pipe 1 is not to be considered a limitation of the present invention, and other suitable and well-known materials may, otherwise, be employed herein. The body of pipe 1 includes a hollow tobacco magazine 2 and a hollow and preferably cylindrical tobacco cutting and smoking chamber 4. An elongated pipe stem 6 extends outwardly from tobacco cutting and smoking chamber 4. As will be explained in greater detail hereinafter, tobacco smoke from cutting and smoking chamber 4 may be drawn to the mouth of a smoker by way of pipe stem 6. Pipe stem 6 is preferably screw threaded so as to permit an easy connection to or disassembly from tobacco cutting and smoking chamber 4 at an aperture 8. Aperture 8 is correspondingly screw-threaded and extends through the walls of pipe 1 into cutting and smoking chamber 4, so that pipe stem 6 may communicate with chamber 4.

Tobacco magazine 2 has an opened first end which, as is best shown in FIG. 1, communicates with tobacco cutting and smoking chamber 4. The second end of tobacco magazine 2 is provided with screw threads 10, whereby to permit a suitable end cap 12, having corresponding screw threads, to be connected thereat. Accordingly, end cap 12 may be removed from tobacco magazine 2 in order that a suitable supply of tobacco may be stored within magazine 2. End cap 12 has an aperture formed therein so as to accommodate a shaft or rod member 16 therethrough. One end of shaft 16 terminates at a button 18. The other end of shaft 16 dimensioned so as to form a relatively snug fit within the walls of tobacco magazine 2. The combination including piston shaft 16 and disk-shaped piston 20 is adapted for reciprocal movement through the interior of tobacco magazine 2 whenever the button end 18 of shaft 16 is manually depressed towards and retracted from the end cap 12 of magazine 2. Accordingly, and as will be detailed during a description of the operation of the present pipe 1, a suitable supply of tobacco 14 may be forced from magazine 2 into tobacco cutting and smoking chamber 4 by depressing button end 18 in a direction towards chamber 4.

A hollow, preferably cylindrically shaped tobacco cutter and transport device 22 is dimensioned so as to form a snug fit within the hollow cutting and smoking chamber 4. A first, cutting end 25 of tobacco cutter and transport device 22 includes a plurality of smoke intake ports 24 formed therein (and best shown in FIG. 2). The second end of cutter and transport device 22 is formed with a series of screw threads 26, whereby a knurled end cap 28, having corresponding screw threads, may be removably connected thereat. Thus, by unscrewing and removing end cap 28, the tobacco cutter and transport device 22 may be removed from tobacco smoking chamber 4 and cleaned. As an important detail of the present invention (the advantage of which will be described hereinafter), tobacco cutter and transport device 22 is particularly dimensioned so that in the assembled relationship (of FIG. 1), the cutting end 25 of device 22 having smoke intake ports 24 formed therein terminates at a location above the intersection (e.g. aperture 8) of pipe stem 6 with cutting and smoking chamber 4. As will be disclosed in detail when referring to FIGS. 4–7 hereinafter, tobacco cutter and transport device 22 is manually operated at knurled end cap 28 and adapted to ride through cutting and smoking chamber 4, whereby to cause the cutting end 25 thereof to tear a tobacco plug (e.g., 30) away from the magazine supply 14 thereof and transport the tobacco plug upwardly and inwardly through cutting and smoking chamber 4 to a location above aperture 8 and the intersection of pipe stem 6 with chamber 4, at which location the tobacco plug 24 may be ignited and smoked. Thus, the cutting end 25 of cutter and transport device 22 (and the smoke intake ports 24 therein) separates a tobacco plug 30 from the aperture 8 and pipe stem 6 during the time when the tobacco is smoked.

As another important detail of the present invention, a plurality of smoke transfer ports 32 are formed in a circular configuration around the side of cutter and transport device 22 adjacent the cutting end 25 thereof. When in the assembled relationship (of FIG. 1), a pair of the smoke transfer ports 32 are aligned with the aperture 8. In a preferred embodiment of the present invention, and as is best illustrated in FIG. 2, pipe stem 6 is slightly offset with respect to the center of the cylindrically shaped tobacco cutting and smoking chamber 4. Therefore, the aperture 8 formed at the intersection of pipe stem 6 with cutting and smoking chamber 4 is oval-shaped and of sufficient area to cover a pair of the smoke transfer ports 32 so as to enhance the draw of tobacco smoke by the smoker. That is, regardless of the position of tobacco cutter and transport device 22 when received within cutting and smoking chamber 4, aperture 8 is suitably dimensioned and located so as to surround an area at the side of device 22, which area includes a pair of the transfer ports 32. As will be explained shortly, the smoke intake ports 24 formed in the cutting end 25 of cutter and transport device 22 and the smoke transfer ports 32 formed around the side of device 22 are arranged to form a passageway through which tobacco smoke may be inhaled by the smoker from the tobacco plug 30 via pipe stem 6.

As previously disclosed, tobacco cutter and transport device 22 is of hollow construction. A cylindrically shaped, hollow plug member 34 is positioned at the interior of device 22. Plug member 34 is of suitable dimension to form a snug fit when inserted within the interior of cutter and transport device 22. One end of plug member 34 terminates at and is integrally connected to the knurled end cap 28. Thus, when end cap 28 is unscrewed and removed from cutter and transport device 22, plug member 34 is, likewise, withdrawn from (the interior of) device 22. The second end of plug member 34 terminates within tobacco cutter and transport device 22 at a location (as best illustrated in FIG. 1) below the aperture 8. Accordingly, an annular space 36 is formed at the interior of tobacco cutter and transport device 22 between the second end of plug member 34 and the cutting end 25 of device 22.

A well-known problem with many conventional pipes is that hot tobacco or ash is frequently drawn from a burning supply thereof to the tongue or mouth of the smoker via the pipe stem. Such burning tobacco ash has been known to cause injury to the smoker. However, and in accordance with the present invention, means are provided by which to substantially prevent hot tobacco from being drawn to the mouth of the smoker, whereby to minimize the risk of injury. More particularly, the smoker ignites a plug 30 of tobacco which has been cut from tobacco supply 14 and transported to the top of cutting and smoking chamber 4 by the cutting end 25 of tobacco cutter and transport device 22. In the assembled pipe configuration of FIG. 1, the burning tobacco plug 30 is supported within cutting and smoking chamber 4 by the cutting end 25 of device 22. Tobacco smoke is inhaled by the smoker from tobacco plug 30 through a path including smoke intake ports 24, annular space 36, a pair of smoke transfer ports 32, and pipe stem 6. It is to be recognized that the longitudnal axes of smoke intake ports 24 (which extend through the cutting end 25 of cutter and transport device 22) and the longitudinal axes of smoke transfer ports 32 (which extend through the side of device 22) project in different directions, which directions are in substantially perpendicular alignment with one another. As an important advantage of the present invention, it has been found that because of the (right) angled smoke path including ports 24 and 32, burning tobacco ash which is drawn by the smoker from tobacco plug 30 into annular space 36 remains trapped within space 36 and along the walls of cutting and smoking chamber 4. Therefore, tobacco smoke being inhaled by way of pipe stem 6 will be substantially devoid of hot tobacco or burning ash.

As an additional embodiment of the present invention, a well-known filter element, designated 38, may be placed within annular space 36 between plug member 34 and the cutting end 25 of tobacco cutter and transport device 22. Hence, burning tobacco ash and other undesirable contaminants may be advantageously trapped within filter element 38. Filter element 38 may be easily replaced by merely unscrewing knurled end cap 28 and removing plug member 34 from the interior of tobacco cutter and transport device 22. Moreover, and unlike conventional pipes which typically include a filter element located within the pipe stem thereof, the presently described filter element 38 is of sufficient size and location to remove undesirable contaminants from the tobacco smoke without unduly restricting the flow of smoke through the pipe stem 6.

Another important feature of the present pipe 1 is best shown in FIG. 1. A cleaning means, such as a brush 40, or the like, having a shaft 44 is disposed at the interior of hollow plug member 34. An opening 42 is formed through knurled end cap 28, so that brush 40 may be removed from or inserted into the body of plug member 34. Brush shaft 44 has a button-shaped top portion 46 connected thereto opposite brush 40. Knurled end cap 28 has a raised lip 48 formed around the perimeter thereof. The button-shaped top portion 46 of brush shaft 44 is received, in the assembled relationship of FIG. 1, within the opening 42 in end cap 28 so as to lie flush with raised lip 48. When it becomes desirable to clean the present pipe 1, the smoker grips the button portion 46 with his fingers and withdraws button portion 46 from the lip 48 at end cap 28. Accordingly, the shaft 44 and brush 40 are withdrawn (shown in phantom and illustrated at reference numeral 46') from the interior of hollow plug member 34, so that the self-contained cleaning means (i.e., brush 40) may be conveniently used to clean the present pipe 1 (and particularly the smoke intake ports 24 in the cutting end 25 of cutter and transport device 22) when the component parts thereof are disassembled.

Figure 3:
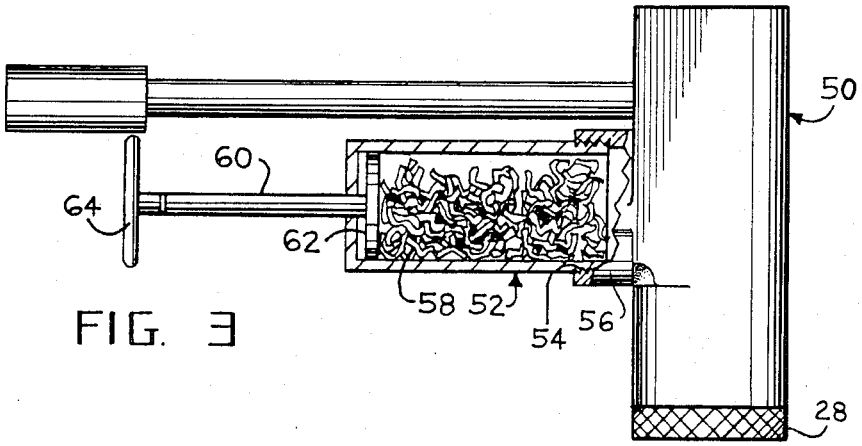
FIG. 3 shows a modification to the pipe of FIG. 1.

FIG. 3 of the drawings shows a modification of the pipe structure of FIGS. 1 and 2. The pipe 50 of FIG. 3 is of similar construction to that illustrated and disclosed when referring to FIGS. 1 and 2. However, pipe 50 includes a tobacco magazine 52 which may be removably connected to the pipe body and to the tobacco cutting and smoking chamber. More particularly, one end of tobacco magazine 52 includes suitable screw threads 54. The body of pipe 50 has a flange 56 coextensively formed therewith and extending outwardly therefrom. Flange 56 has a corresponding set of screw threads so as to receive the tobacco magazine 52 thereat. In the event that a supply of tobacco 58 which is stored within magazine 52 becomes exhausted, the smoker may unscrew magazine 52 from flange 56 and either reload magazine 52 with a new tobacco supply or substitute a new tobacco filled magazine therefor. As shown in FIG. 3, tobacco magazine 52 may have any convenient size in order to accommodate a suitable amount of tobacco 58 therewithin and minimize the need for the smoker to continuously replenish an exhausted tobacco supply.

The opposite end of tobacco magazine 52 has an aperture formed therein through which to receive a piston shaft 60. One end of piston shaft 60 has a disk-shaped piston 62 formed thereat. The other end of the shaft 60 includes a button end 64. Button end 64 may be depressed so as to cause shaft 60 and piston 62 to ride through the interior of tobacco magazine 52 and thereby manually force a plug of tobacco from magazine 52 into the cutting and smoking chamber (not shown). Thus, the operation of piston members 60, 62 and 64 with tobacco magazine 52 is the same as that described when referring to the tobacco magazine 2 of FIGS. 1 and 2.

Figure 4:
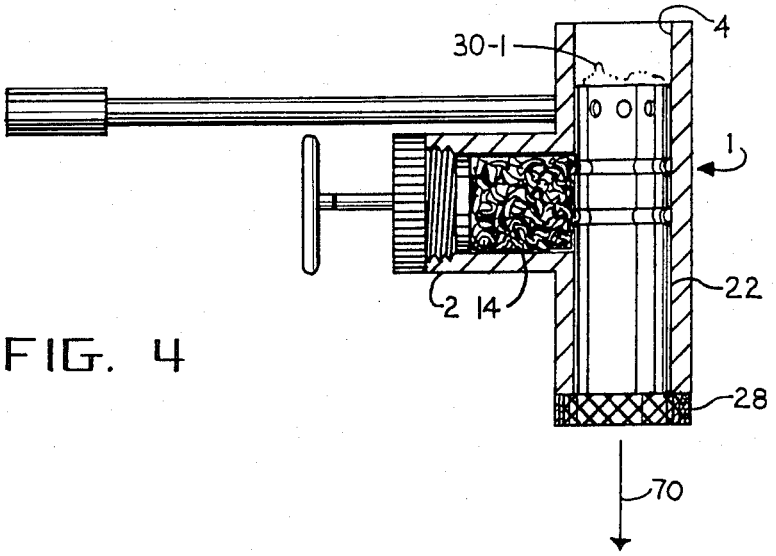
FIGS. 4 through 7 illustrate, in partial cross-section, the operation of the pipe of FIG. 1.

The operation of the presently disclosed tobacco smoking pipe 1 is now described while referring concurrently to FIGS. 4–7 of the drawings. FIG. 4 shows the pipe 1 with tobacco magazine 2 fully loaded with a supply of tobacco 14. In FIG. 4, a plug of tobacco (designated 30-1) within cutting and smoking chamber 4 has been smoked, and the smoker is ready to replenish the exhausted plug with fresh tobacco from magazine 2.

Accordingly, the smoker grasps the end cap 28 of tobacco cutter and transport device 22 and moves device 22 downward and outwardly through chamber 4 in the direction indicated by the arrow 70.

Figure 5:
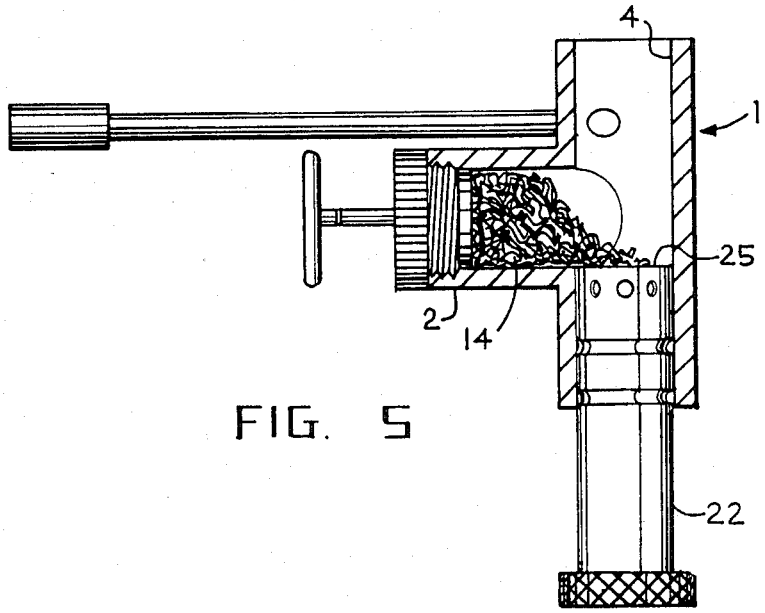

FIG. 5 shows the position of tobacco cutter and transport device 22 within tobacco cutting and smoking chamber 4 before fresh tobacco is moved into cutting and smoking chamber 4 from tobacco magazine 2. That is, the cutting end 25 of device 22 is positioned below the interface of magazine 2 with cutting and smoking chamber 4 so as to permit communication between the stored tobacco supply 14 and chamber 4.

Figure 6:
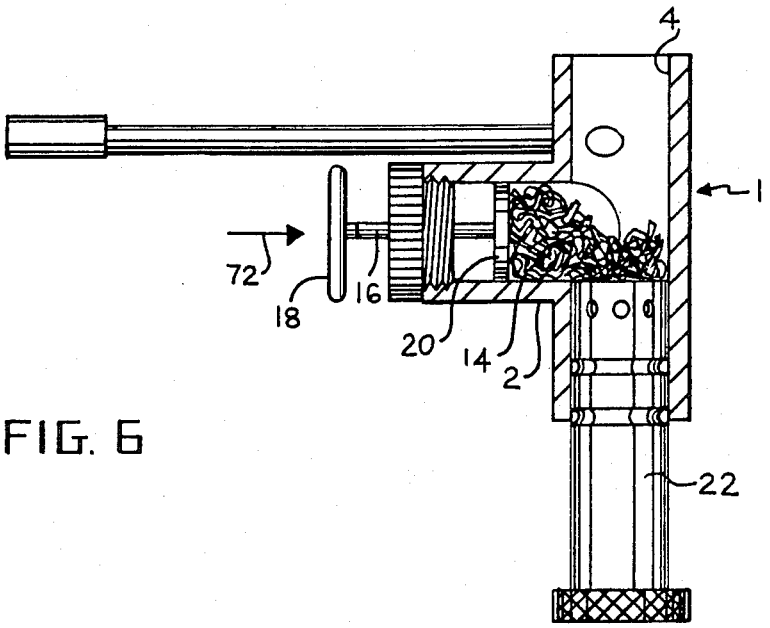
Figure 7:
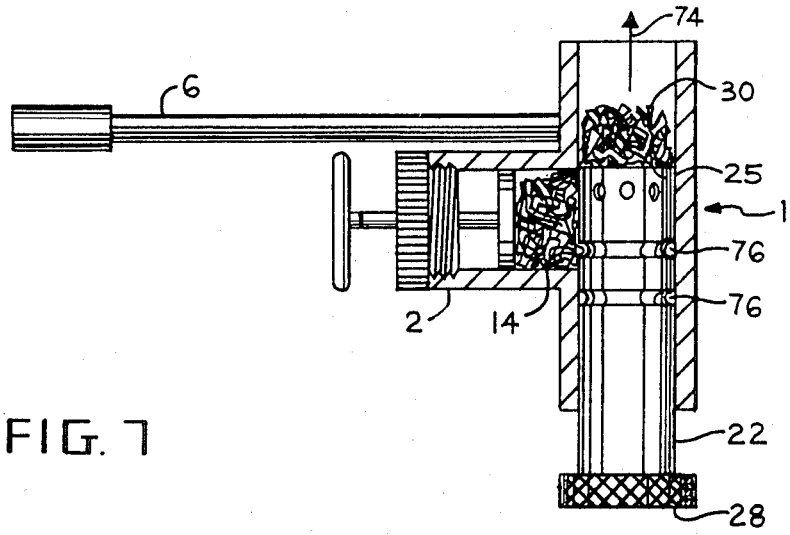

In FIG. 6, a desired amount of tobacco from magazine supply 14 is moved from magazine 2 into tobacco cutting and smoking chamber 4. As previously disclosed, the button end 18 of piston shaft 16 is manually depressed in a direction towards chamber 4, as indicated by arrow 72, so as to cause disk-shaped piston 20 to travel through the interior of magazine 2, whereby to move the tobacco supply 14 from magazine 2 into chamber 4.

In FIG. 7, the smoker again grasps the end cap 28 of tobacco cutter and transport device 22 and moves device 22 upward and inwardly through tobacco cutting and smoking chamber 4 in the direction indicated by the arrow 74. During the inward ride of cutter and transport device 22 through chamber 4, a plug 30 of tobacco is cut or torn away from the magazine supply 14 thereof by the cutting end 25 of cutter and transport device 22. As the cutting end 25 of device 22 travels through cutting and smoking chamber 4, the tobacco plug 30 is transferred to a location above the intersection of pipe stem 6 with chamber 4 (best shown in FIG. 1). Tobacco cutter and transport device 22 is returned to the assembled position (of FIG. 1), whereupon the fresh tobacco plug 30 is now ready to be smoked. When tobacco plug 30 is spent, the smoker may replenish the exhausted plug by repeating the process described while referring to FIGS. 4–7. Therefore, the smoker will have relatively quick access to a renewed plug of tobacco (from magazine 2) with less inconvenience than that encountered when reloading the bowl of a conventional pipe from a tobacco pouch or cannister.

As previously described when referring to FIG. 1, the presently disclosed pipe may be easily disassembled for the purpose of cleaning (such as by means of the self-contained brush 40) or repair. More particularly, tobacco cutter and transport device 22 may be withdrawn from tobacco cutting and smoking chamber 4 so as to permit access to chamber 4. Moreover, knurled end cap 28 may be unscrewed and removed together with plug member 34 from cutter and transport device 22, so as to expose the interior of device 22 and permit access to the filter element 38 located therewithin. Tobacco magazine 2 may be reloaded with tobacco or cleaned by unscrewing and removing end cap 12 (and piston 20) therefrom.

Referring once again to FIG. 7, tobacco cutter and transport device 22 may have one or more grooves 76 formed therein and extended around the cylindrical body thereof. Grooves 76 are sized to engage the magazine tobacco supply 14 during the reciprocal movement of cutter and transport device 22 through tobacco cutting and smoking chamber 4. Thus, grooves 76 receive some of the tobacco supply 14 therewithin, whereby to cause tobacco cutter and transport device 22 to be retained at the interior of smoking chamber 4. It might also be appreciated that the movement of piston 20 through magazine 2 acts to compress the tobacco supply 14 against device 22. Accordingly, a relatively larger and better packed supply of tobacco may be stored within magazine 2.

Figure 8:
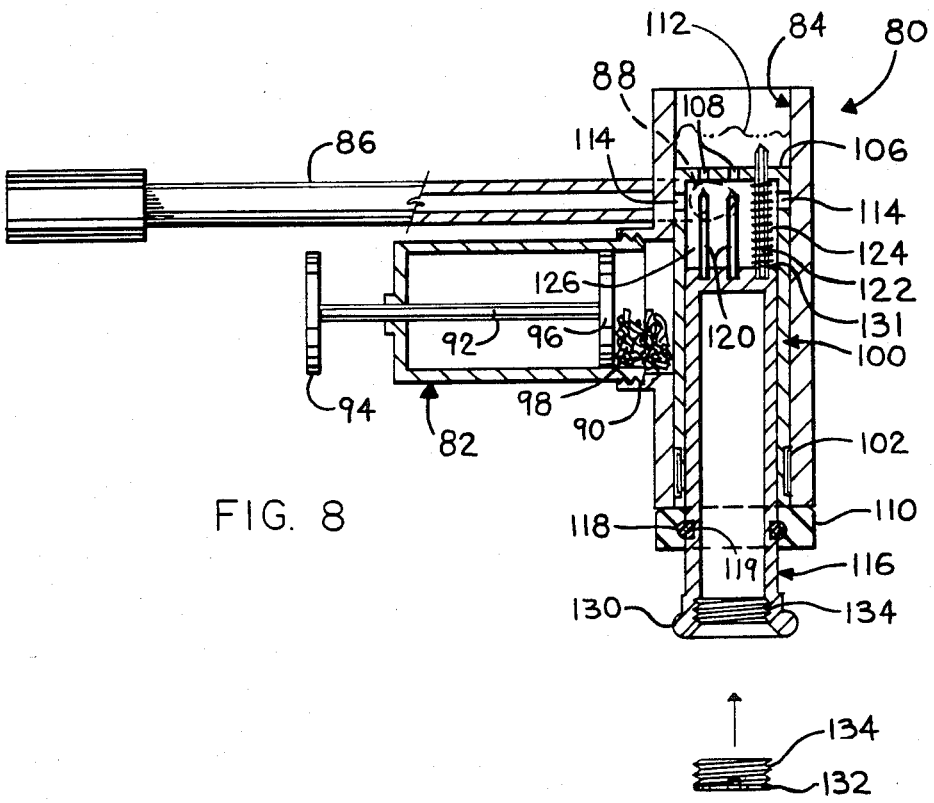
FIG. 8 shows a partial cross-section through the side of a tobacco smoking pipe which forms a second preferred embodiment of the present invention.
Figure 9:
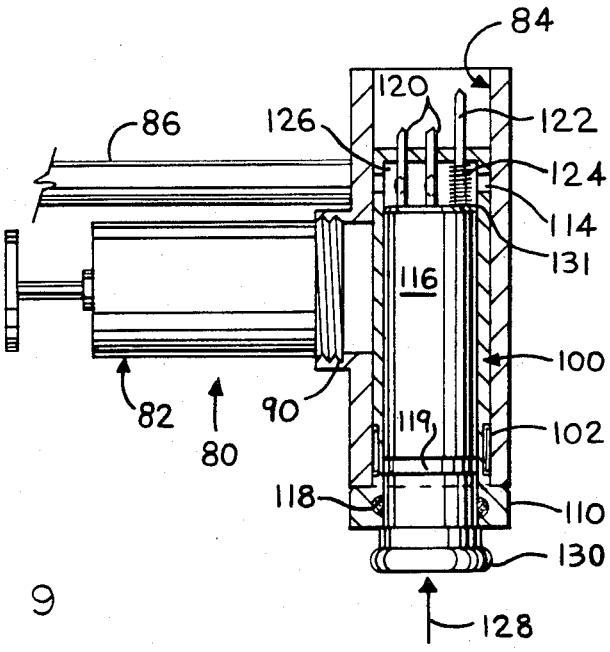
FIG. 9 illustrates, in partial cross-section, the operation of the self-contained cleaning means for the pipe of FIG. 8.
Figure 10:
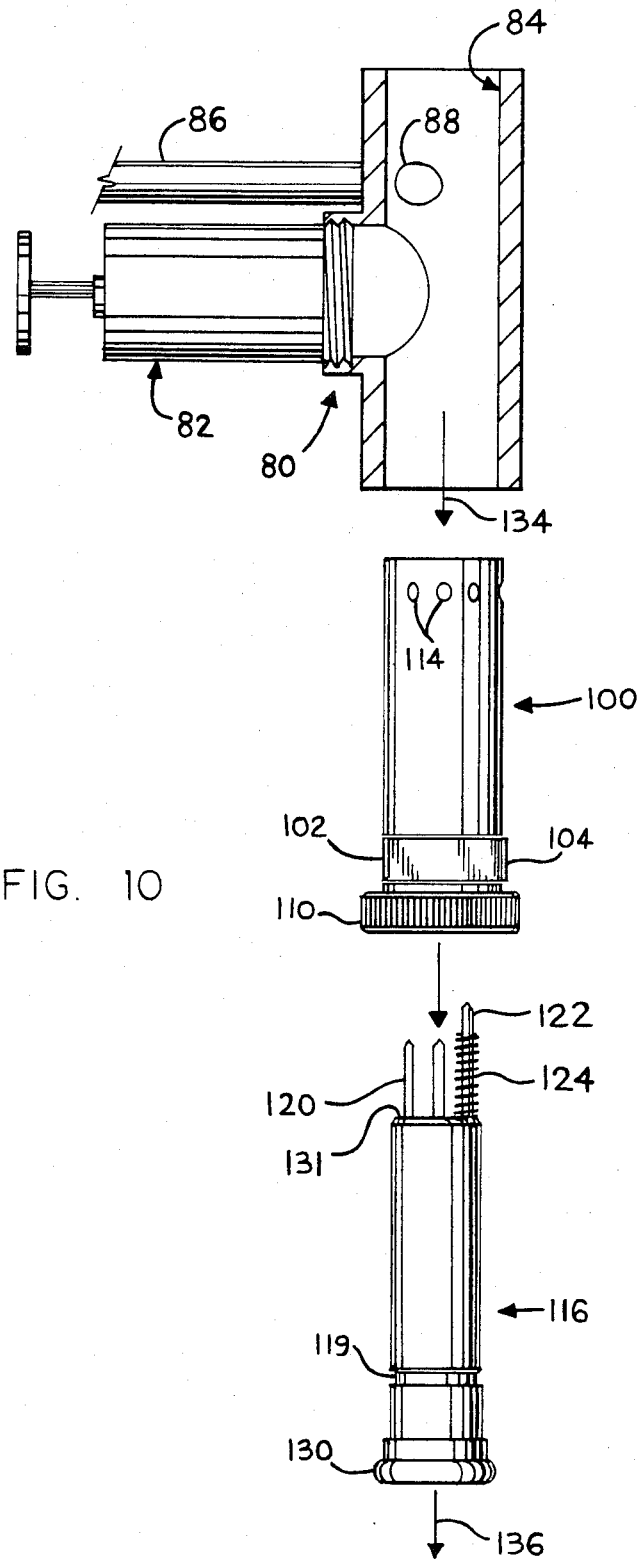
FIG. 10 illustrates the disassembly of the pipe of FIG. 8.

A tobacco smoking pipe having a unique self-contained cleaning assembly and being formed in accordance with a second preferred embodiment of the present invention is described while referring concurrently to FIGS. 8–10 of the drawings. Similar to the pipe 1 illustrated in FIGS. 1–3, the presently disclosed pipe 80 includes a hollow and generally cylindrical tobacco magazine 82 and a hollow and generally cylindrical tobacco cutting and smoking chamber 84. An elongated pipe stem 86 extends outwardly from an aperture 88 formed in tobacco cutting and smoking chamber 84, so that tobacco smoke can be drawn from cuttng and smoking chamber 84 to the mouth of the smoker.

Tobacco magazine 82 has an opened first end which is removably connected to tobacco cutting and smoking chamber 84 by means of complementary screw threads 90 formed at each of magazine 82 and chamber 84. Accordingly, tobacco magazine 82 may be removed from tobacco cutting and smoking chamber 84 in order that a supply of tobacco may be stored within magazine 82. The second end of tobacco magazine 82 has an aperture formed therein so as to accommodate a shaft or rod member 92 therethrough. One end of shaft 92 terminates at a button 94, and the other end of shaft 92 terminates at a disk-shaped piston 96. Piston 96 is dimensioned so as to form a relatively snug fit within the walls of tobacco magazine 82. The combination including piston shaft 92 and disk-shaped piston 96 is adapted for reciprocal movement through the interior of tobacco magazine 92 whenever the button end 94 of shaft 92 is manually depressed towards and pulled away from cutting and smoking chamber 84. Thus, and as previously detailed in the pipe embodiment oof FIGS. 1–7, a suitable supply of tobacco 98 may be forced from magazine 82 into cutting and smoking chamber 84 by pressing button end 94 inwardly and in a direction towards chamber 84.

A hollow and generally cylindrical tobacco cutter and transport device 100 is dimensioned so as to form a snug fit at the interior of cutting and smoking chamber 84. As is best shown in FIG. 10, a spring member 102 is located within a recess and coiled around the body of tobacco cutter and transport device 100. Spring 102 may be fabricated from a piece of flat spring steel, or any other suitable material. Spring 102 is coiled around cutter and transport device 100, and a small resilient rise 104 is formed (e.g. bent) at one end thereof. Resilient rise 104 is dimensioned so as to cause spring 102 to bear against the interior walls of tobacco cutting and smoking chamber 84. Hence, when tobacco cutter and transport device 100 is removably inserted within tobacco cutting and smoking chamber 84, in the assembled relationship of FIG. 8, the contact made by the resilient rise of spring 102 functions to retain device 100 within the interior of chamber 84.

A first cutting end 106 of tobacco cutter and transport device 100 includes a plurality of smoke intake ports 108 formed therein (and best shown in FIG. 8). The second end of cutter and transport device 100 terminates at a knurled ridge 110, which is coextenisvely formed with and extended outwardly from cutter and transport device 100. By virtue of knurled ridge 110, a smoker may selectively locate tobacco cutter and transport device 100 within hollow tobacco cutting and smoking chamber 84, the advantage of which will be disclosed hereinafter.

Similar to the pipe embodiment of FIGS. 1–7, tobacco cutter and transport device 100 is particularly dimensioned so that in the assembled relationship (of FIG. 8), the cutting end 106 of device 100 has a plurality of smoke intake ports 108 formed therein, which cutting end and ports are located above the intersection (e.g. aperture 88) of pipe stem 86 with cutting and smoking chamber 84. Therefore, and in operation, tobacco cutter and transport device can be manually manipulated at the knurled ridge 110 thereof so as to be forced to ride through the interior of cutting and smoking chamber 100, whereby to cause the cutting end 106 to tear a plug of tobacco (e.g. 112) away from the magazine supply 98 and transport the tobacco plug 112 upwardly through cutting and smoking chamber 84 to a location above aperture 88 and the intersection of pipe stem 86 with chamber 84, at which location the tobacco plug 112 may be ignited and smoked. Thus, the cutting end 106 of cutter and transport device 100 separates a tobacco plug 112 from the aperture 88 and pipe stem 86 during the time when the tobacco is smoked. As will be explained below, the positioning of tobacco plug 88 above and apart from aperture 88 prevents most hot tobacco and burning ash from being drawn to the smoker via pipe stem 86, whereby to minimize the risk of injury to the smoker's lips and mouth.

A plurality of smoke transfer ports 114 are formed in a circular configuration around the side of tobacco cutter and transport device 100 ajdacent the cutting end 106 thereof. When in the assembled relationship (of FIG. 8), a pair of the smoke transfer ports 114 are aligned with the aperture 88 formed through tobacco cutting and smoking chamber 84. Because of the (slightly offset) alignment of pipe stem 86 with the center of cutting and smoking chamber 84, the aperture 88 formed at the intersection of pipe stem 86 with cutting and smoking chamber 84 is oval-shaped and of sufficient area to cover a pair of smoke transfer ports 114, so as to enhance the draw of tobacco smoke therethrough. That is, regardless of the position of tobacco cutter and transport device 100 within cutting and smoking chamber 84, aperture 88 is of sufficient dimension and location so as to surround an area at the side of cutter and transport device 100 to accommodate a pair of the transfer ports 114. Accordingly, tobacco smoke is inhaled by the smoker from a tobacco plug 112 through a path including smoke intake ports 108, a pair of smoke transfer ports 114, oval-shaped aperture 88, and pipe stem 86. It should be recognized that the longitudinal axes of smoke intake ports 108 (which extend through the cutting end 106 of cutter and transport device 100) and the longitudinal axes of smoke transfer ports 114 (which extend through the sides of cutter and transport device 100) project in different directions, which directions are in substantially perpendicular alignment with one another. Thus, and as an important advantage of the pipe of the present embodiment, it has been found that because of the (right) angled smoke path including ports 108 and 114, hot tobacco and burning ash which are drawn by the smoker from tobacco plug 112 through smoke intake ports 108 will not be transmitted through smoke transfer ports 114 to pipe stem 86, but will, otherwise, remain trapped at a region 126 within the confines of tobacco cutter and transport device 100. Therefore, tobacco smoke being inhaled by way of pipe stem 86 will be substantially devoid of hot tobacco or burning ash.

In accordance with the present embodiment, the pipe 80 is provided with a self-contained assembly by which to facilitate a pipe cleaning without either of conventional pipe cleaners or a timing consuming pipe disassembly or the annoying necessity of striking the pipe against a hard surface, as has been common to cleaning pipes of the prior art. More particularly, a hollow and generally cylindrical cleaning insert 116 is dimensioned to fit snugly within the interior of hollow tobacco cutter and transport device 100. An O-ring 118 of conventional design is secured in a groove formed at the interior of cutter and transport device 100. A complementary annular recess 119 is formed around the body and adjacent a grip end 130 of cleaning insert 116 so as to receive O-ring 118 therein when cleaning insert 116 is suitably located within the interior of tobacco cutter and transport device 100. Hence, the receipt of O-ring 118 at the recess 119 removably secures the cleaning insert at a desired location (as represented in FIG. 1) within cutter and transport device 100 when a plug of tobacco 112 is to be smoked.

A cleaning end 131 of guide insert 116 is provided with a plurality of cleaning pins 120 fixedly connected thereto. Typically, one cleaning pin 120 is provided for each smoke intake port 108 that is formed through the cutting end 106 of tobacco cutter and transport device 100. A guide pin 122, also fixedly connected to the cleaning end 131 of cleaning insert 116, is elongated relative to the length of each of the cleaning pins 120. Elongated guide pin 122 is selected to be of sufficient length so that in the assembled relationship of FIG. 8, cleaning pin 122 extends upwardly from cleaning insert 116 and through a corresponding smoke intake port 108. In operation, guide pin 122 provides a means for aligning each of the cleaning pins 120 with a respective smoke intake port 108. A conventional helically wound compression spring 124 is positioned over elongated guide pin 122 and located between the cleaning end 131 of cleaning insert 116 and the cutting end 106 of tobacco cutter and transport device 100. Accordingly, and as will be explained in greater detail hereinafter, by virtue of spring 124, cleaning insert 116 is adapted for reciprocal movement through the interior of tobacco cutter and transport device 100.

The operation of the cleaning assembly of the present pipe embodiment 80 is now disclosed in detail. In the assembled relationship of FIG. 8, the smoker is able to ignite and smoke a plug 112 of tobacco within tobacco cutting and smoking chamber 84, as previously disclosed. Accordingly, smoke is drawn from tobacco plug 112 to the pipe stem 86 via smoke intake ports 108 and smoke transfer ports 114. However, and after prolonged use, some or all of the smoke intake ports 108 will typically become clogged with byproducts of the burning plug 112 of tobacco, whereby to undesirably restrict the flow of air and tobacco smoke through ports 108.

To quickly and easily clean smoke intake ports 108 and, thereby, remove any undesirable tobacco byproducts therefrom, the smoker merely presses upwardly (in a direction represented by the arrow designated 128 in FIG. 9) upon the grip end 130 of cleaning insert 116, so as to move cleaning insert 116 against the bias of spring 124. Accordingly, spring 124 is compressed, and elongated guide pin 122 is, correspondingly, moved beyond its respective smoke intake port 108. Each of the array of cleaning pins 120 is likewise moved upwardly and through its respective smoke intake port 108. The upward movement of cleaning pins 120 through respective ports 108 causes the removal of any blockage of ports 108. After the aforementioned operation by which smoke intake ports 108 are cleaned, the smoker ceases to press the grip end 130 of cleaning insert 116. Accordingly, spring 124 expands back to its original, uncompressed configuration, whereby to cause cleaning insert 116 to move downwardly (and in a direcion opposite to that represented by arrow 128 of FIG. 9) through the interior of tobacco cutter and transport device 100. Thus, cleaning pins 120 are withdrawn from their respective intake ports 108, so that the subsequent draw of tobacco smoke and air through intake ports 108 will be substantially unimpeded by accumulated residue from a burning tobacco plug 112.

By virtue of the reciprocal movement of cleaning insert 116 and cleaning pins 120 through the interior of tobacco cutter and transport device 100, means are also provided by which to selectively adjust the rate at which air and tobacco smoke can be drawn through smoke intake ports 108. That is, as cleaning pins 120 are moved upwardly and into respective intake ports 108, less air and smoke are permitted to flow therethrough. Thus, by depressing (in the direction of arrow 128) the grip end 130 of cleaning insert 116, the smoke may variably control the draw of smoke and air through pipe stem 86.

Moreover, by virtue of the reciprocal movement of cleaning insert 116 through the interior of tobacco cutter and transport device 100, the accumulation of tar and other undesirable tobacco byproducts will be substantially avoided. That is, it will be unlikely for cleaning insert 116 to become frozen against the interior walls of cutter and transport device 100, as a consequence of tar build-up, and the like. Thus, the disassembly of tobacco cutter and transport device 100 from cleaning insert 116 (best described while referring to FIG. 10) will not be inhibited.

What is even more, the reciprocal movement of cleaning insert 116 through the interior of cutter and transport device 100 causes air to be pumped upwardly and through the smoke intake ports 108 at the cutting end 106 of cutter and transport device 100. That is, cleaning insert 116 operates as a piston to force air from region 126 through intake ports 108. Accordingly, the resulting rush of air helps to remove any tobacco residue remaining after cleaning pins 120 are withdrawn from smoke intake ports 108. Therefore, and by virtue of the unique self-cleaning assembly of the present pipe configuration 80, a smoker may quickly and easily clean smoke intake ports 108 without either blowing air through intake ports 108 or striking the tobacco cutting and smoking chamber 84 against a hard surface in order to dislodge burnt tobacco residue, as has typically been required for pipe configurations of the prior art.

The hollow interior of cleaning insert 116 may function as a convenient storage means, in which either matches, an additional tobacco supply, or the like may be stored for subsequent retrieval and use. The cleaning insert 116 may be opened or closed by means of a suitable cap 132 positiond at the grip end 130 thereof. Both cap 132 and the grip end 130 of cleaning insert 116 are provided with complementary screw threads 134 by which to enable cap 132 to be removably connected to cleaning insert 116.

The disassembly of the pipe 80 is best shown in FIG. 10. It may become necessary for the smoker to disconnect and separate tobacco cutting and smoking chamber 84, tobacco cutter and transport device 100, and cleaning insert 116. More particularly, tobacco cutter and transport device 100 may be removed from the interior of tobacco cutting and smoking chamber 84 by griping knurled ridge 110 and forcing cutter and transport device 100 downwardly and in a direction best represented by the arrow 134. Sufficient downward force must be exerted upon cutter and transport device 100, so that rise 104 of spring 102 will be disenaged from cutting and smoking chamber 84. Cleaning insert 116 may be removed from the interior of cutter and transport device 100 by grasping the grip end 130 thereof and forcing cleaning insert 116 downwardly and in a direction best represented by the arrow 136. Sufficient downward force must be exerted upon cleaning insert 116 so as to move the annular recess 119 formed around the body of insert 116 out of engagement with the O-ring (best illustrated in FIGS. 7 and 8) of cutter and transport device 100. Accordingly, the components of pipe 80 may be separated from one another so as to facilitate the step of cleaning, repair, or replacement. The pipe components of FIG. 10 may be positioned in the assembled relationship (of FIG. 8) by reconnecting tobacco cutting and smoking chamber 84, tobacco cutter and transport device 100, and cleaning insert 116 in a manner that will be apparent to those skilled in the art.

It will be apparent that while the preferred embodiments of my invention have been shown and described, various modifications and changes may be made without departing from the true spirit and scope of the invention.

Having thus set forth the preferred embodiments of the present invention, what is claimed is:

1. A tobacco smoking pipe having a hollow smoking chamber for receiving a plug of tobacco to be smoked and a pipe stem interconnected with said smoking chamber so that tobacco smoke can be drawn therethrough to the mouth of the smoker, said pipe comprising:

tobacco magazine means communicating with said smoking chamber for storing a supply of tobacco to be smoked, means by which to move an amount of tobacco from the supply thereof in said magazine into said smoking chamber, tobacco cutting and transporting means being of hollow construction and having a cutting surface formed at an end thereof, said cutting and transporting means being dimensioned to travel through said smoking chamber in order to cause said cutting end surface to cut off a plug of tobacco that has been moved from said magazine into said cutting chamber, said cutting end surface having at least first and second smoke intake ports extending therethrough through which tobacco smoke can be drawn, and cleaning means located at the hollow interior of said tobacco cutting and transporting means and dimensioned to be moved therethrough, said cleaning means including at least one elongated cleaning pin and at least one elongated guide pin, said guide pin extending in substantially parallel alignment with and having a length which is longer than said cleaning pin, said guide pin being of sufficient length to be received through a first of said smoke intake ports at the cutting end surface of said cutting and transporting means for aligning said cleaning pin for receipt by said second smoke intake port, and said cleaning pin being forced through said second smoke intake port to remove tobacco residue therein when said cleaning means is moved through said cutting and transporting means in a direction towards the cutting end surface thereof.

2. The tobacco smoking pipe recited in claim 1, including spring means positioned between said cleaning means and the cutting end surface of said tobacco cutting and transporting means, said spring means being compressed when said cleaning means is moved through said tobacco cutting and transporting means in a first direction to cause said cleaning pin to be forced through said second smoke intake port, and said spring means wanting to expand to bias said cleaning means for movement in a second and opposite direction for adapting said cleaning means for reciprocal movement through said cutting and transporting means.

3. The tobacco smoking pipe recited in claim 1, wherein said cleaning means is of hollow construction, said cleaning means having an end cap removably connected thereto by which to permit access to be gained to the hollow interior of said cleaning means for the purpose of storage within said cleaning means when said end cap is removed therefrom.

4. The tobacco smoking pipe recited in claim 1, further comprising retaining spring means interfaced with said tobacco cutting and transporting means, so that said cutting and transporting means can be removably retained within the interior of said smoking chamber.

5. A tobacco smoking pipe having a hollow smoking chamber for receiving a plug of tobacco to be smoked and a pipe stem interconnected with said smoking chamber so that tobacco smoke can be drawn therethrough to the mouth of the smoker, said pipe comprising:

tobacco magazine means communicating with said smoking chamber for storing a supply of tobacco to be smoked, means by which to move an amount of tobacco from the supply thereof in said magazine into said smoking chamber, tobacco cutting and transporting means comprising at least one sidewall connected to a cutting surface formed at an end of said sidewall to define a hollow interior, said cutting and transporting means adapted to move through said hollow smoking chamber in order to cause said cutting end surface to cut off a plug of tobacco that has been moved from said magazine into said smoking chamber and transport the tobacco plug to a location in said smoking chamber that is separated from the location of the interconnection of said pipe stem with said smoking chamber, said cutting end surface having at least one smoke intake port extending therethrough through which tobacco smoke can be drawn, and cleaning means removably positioned at the hollow interior of said cutting and transporting means and adapted to be moved therethrough, said cleaning means establishing a space extending at least between the smoke intake port at the cutting end surface of said cutting and transporting means and the interconnection of said pipe stem with said smoking chamber, so that burning ash that is drawn through said intake port from the tobacco plug can be retained in said space until said cleaning means is removed from the interior of said cutting and transporting means in order to permit the removal of burnt tobacco ash and the cleaning of the interior of said cutting and transporting means, said cleaning means including at least one elongated cleaning pin extending through said space in a direction towards the cutting end surface of said cutting and transporting means, said cleaning pin being forced through said at least one smoke intake port to remove tobacco residue therefrom when said cleaning means is moved through the interior of cutting and transporting means.

6. The tobacco smoking pipe recited in claim 5, wherein said cleaning means also includes an elongated guide pin extending through said space in substantially parallel alignment with said cleaning pin, said guide pin having a length which is longer than the length of said cleaning pin, and said guide pin being of sufficient length to be received through a second smoke intake port formed at the cutting end surface of said tobacco cutting and transporting means for aligning said cleaning pin for receipt by said at least one smoke intake port when said cleaing means is moved through the interior of said cutting and transporting means.

7. The tobacco smoking pipe recited in claim 5, including spring means positioned between said cleaning means and the cutting end surface of said tobacco cutting and transporting means, said spring means being compressed when said cleaning means is moved in a first direction through said tobacco cutting and transporting means and said cleaning pin is forced through said at least one smoke intake port, and said spring means wanting to expand to bias said cleaning means for movement in a second and opposite direction, thereby adapting said cleaning means for reciprocal movement through said cutting and transporting means.

8. The tobacco smoking pipe recited in claim 5, wherein said cleaning means is adapted to move through said tobacco cutting and transporting means independently of the movement of said cutting and transporting means through said smoking chamber.

9. A tobacco smoking pipe having a hollow smoking chamber in which a plug of tobacco is to be smoked and a pipe stem interconnected with said smoking chamber so that tobacco smoke can be drawn therethrough to the mouth of the smoker, said pipe also having surface means extending across said smoking chamber for receipt of the plug of tobacco to be smoked, said surface means having at least first and second smoke intake ports extending therethrough in fluid communication with said pipe stem, and cleaning means positioned within the interior of said smoking chamber and adapted to be moved therethrough, said cleaning means including at least one elongated cleaning pin and at least one elongated guide pin, said guide pin extending in substantially parallel alignment with and having a length which is longer than said cleaning pin, said guide pin being of sufficient length to be received through a first of said smoke intake ports at said tobacco plug receiving surface means for aligning said cleaning pin for receipt by the second of said smoke intake ports, and said cleaning pin being forced through said second smoke intake port to remove tobacco residue therein when said cleaning means is moved through said smoking chamber in a direction towards said surface means.

* * * * *